US005731554A

United States Patent [19]

Anagnos

[11] Patent Number: 5,731,554

[45] Date of Patent: Mar. 24, 1998

[54] OPTIMIZED LOUDSPEAKER TRANSDUCER MONUTING SYSTEM

[75] Inventor: Daniel P. Anagnos, Grandview, N.Y.

[73] Assignees: Sony Corporation, Japan; Sony Electronics Inc.

[21] Appl. No.: 739,968

[22] Filed: Oct. 30, 1996

[51] Int. Cl.[6] ..... A47B 81/06

[52] U.S. Cl. ..... 181/199; 181/150; 381/205

[58] Field of Search ..... 181/144, 145, 181/146, 147, 150, 151, 199, 171; 381/158, 188, 205

[56] References Cited

U.S. PATENT DOCUMENTS

| | | | |
|---|---|---|---|
| 3,771,621 | 11/1973 | Goetti | 181/150 |
| 4,289,929 | 9/1981 | Hathaway | 181/147 |
| 5,115,884 | 5/1992 | Falco | 181/151 |

OTHER PUBLICATIONS

Sorothane Manual, "The Ultimate Damping & Isolation Material," Sorbothane Inc., 2144 State Route 59, Kent, OH 44240, Jun. 1995.

E.A.R. Technical Data Sheet TDS-11, Division, Cabot Safety Corporation, Delaware Industrial Park, Newark, DE 19713, undated.

Bostik Manual, Product Data: Bostik 7132/Boscodur #4, Bostik Chemical Group, Middleton, MA 01949, Sep. 1983.

*Primary Examiner*—Khanh Dang

*Attorney, Agent, or Firm*—Ronald P. Kananen

[57] ABSTRACT

An optimal transducer mounting system for loudspeakers which optimizes the attachment of a transducer to a loudspeaker enclosure. The mounting system features T-nuts captured between two bonded layers of a baffle board for receiving mounting screws for mounting the transducer to the baffle board. The mounting system also features a highly compressible, extremely low compression-set, airtight gasket disposed between the transducer and the baffle board.

16 Claims, 3 Drawing Sheets

OPTIMIZED LOUDSPEAKER TRANSDUCER MONUTING SYSTEM

BACKGROUND OF THE INVENTION

1. Field of the Invention

The present invention relates generally to mechanical mounting arrangements and, in particular, to an optimal transducer mounting system for loudspeakers.

2. Description of the Relevant Art

Conventional gaskets have been used to provide a seal between transducers and loudspeaker enclosures. These conventional gaskets provide an initial airtight seal, but tend to develop a compression set over time leading to possible air leaks. In addition, conventional gaskets tend to change their properties with changes in environmental conditions (e.g., temperature and humidity). The resulting compression set will also allow the mounting screws or bolts to loosen with high levels of vibration over long periods of time.

Some conventional gaskets which are not compressible enough tend to reduce the mechanical coupling (i.e., cause decoupling) between the transducer and enclosure. This condition will allow relative motion between the transducer and enclosure resulting in a loss of sound reproduction quality. The use of thread locking fluids or lock washers will help prevent the loosening of mounting screws, but fails to remedy the gasket compression set problem. Conventional gasket materials are urethane foam, paper and cork.

Typically, transducers are mounted to a speaker enclosure using wood screws, machine screws with standard threaded inserts, or machine screws with T-nuts. Wood screws have the least holding strength, tend to easily strip when used in particle board or MDF cabinets, and are most prone to loosening over time. Machine screws used with standard threaded inserts offer much greater holding strength, are less prone to loosening and, when installed in a blind hole, will not allow any air leakage from the cabinet. The greatest disadvantage of a typical threaded insert is its tendency to unscrew or deinstall itself from the cabinet if the mounting screw is highly torqued or over-tightened. Machine screws used with T-nuts have the greatest holding strength and will not deinstall under high torque conditions. They will, however, allow some air leakage from the cabinet since they require a through-hole for mounting.

SUMMARY OF THE INVENTION

It is an object of the present invention to provide a mounting system for mounting a transducer in a loudspeaker that overcomes the problems associated with the existing mounting systems described above.

More specifically, it is an object of the present invention to provide a mounting system for attaching a transducer to a loudspeaker enclosure which provides an airtight seal, as well as a stable and solid mechanical coupling between the transducer and the enclosure (i.e., no relative movement between the two masses).

It is a further object of the present invention to provide an attachment system that remains consistent (i.e., tight and stable) over long periods of time despite large amounts of vibration.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

The present invention provides a transducer mounting system which optimizes the attachment of a transducer to a loudspeaker enclosure by using a highly compressible, extremely low compression set, airtight gasket and a captured, T-nut type insert.

In order to achieve the objects set forth above, the present invention comprises a mounting system for mounting a transducer to an enclosure. The mounting system comprises a baffle board comprising a first substrate bonded to a second substrate, and at least one bore extending through each of the substrates for receiving a transducer. A plurality of mounting holes are formed through the first substrate, the mounting holes each having a counterbore formed in the first substrate on a side facing the second substrate. A T-nut is located in each of the counterbores. The second substrate covers the counterbores so as to form an airtight seal thereover. Threaded fastening members extend through the mounting flange of the transducer and into the mounting holes of the first substrate. The fastening members are threaded into the T-nuts for securing the transducer to the baffle board.

The T-nuts used in the mounting system preferably have barbs formed on the heads thereof for engaging a bottom surface of the counterbores to prevent the T-nuts from rotating as the fastening members are tightened. A gasket is disposed between the mounting flange of the transducer and the first substrate to provide an airtight seal between the transducer and the baffle board.

In accordance with another aspect of the present invention, the objects set forth above are achieved by a method for mounting a transducer to a loudspeaker cabinet, the method comprising the steps of providing an interior substrate and an exterior substrate, forming a bore through each of the substrates for receiving a transducer, forming at least one mounting hole through the exterior substrate, forming a counterbore on one side of the exterior substrate, the counterbore being coaxial with the mounting hole, inserting a T-nut into the counterbore, and bonding the interior substrate to the exterior substrate so that the interior substrate covers the counterbore and forms an airtight seal over the counterbore.

The method further comprises the steps of positioning a transducer in alignment with the bore through the exterior substrate, inserting a fastening member through a mounting flange of the transducer and into the mounting hole of the exterior substrate, threading the fastening member into the T-nut and tightening the fastening member to a predetermined torque. The method also preferably comprises placing a gasket between the exterior substrate and the mounting flange of the transducer.

In accordance with yet another aspect of the present invention, the objects set forth above are achieved by a loudspeaker having an optimal transducer mounting system, comprising an enclosure having a baffle board and at least one transducer mounted to the baffle board by a mounting system. The mounting system comprises a plurality of fastening members extending through a mounting flange of the transducer and into the baffle board. A gasket is placed between the mounting flange and the baffle board, the gasket comprising a thin sheet of casted, fine-celled polyurethane foam material which exhibits open-cell foam characteristics at moderate deflections but is completely airtight at deflections greater than 50%.

The gasket preferably has a nominal thickness of approximately 1.5 mm with skinned top and bottom surfaces. The gasket is compressed between the mounting flange and the baffle board at a deflection greater than 50% to form an airtight seal between the transducer and the baffle board. The gasket material has a high degree of compressibility, a low compression set and resistance to collapse, a high environmental resistance, a high tear resistance, and a high dimensional stability.

BRIEF DESCRIPTION OF THE DRAWINGS

The various features and advantages of the present invention will become more clearly appreciated as a description is made with reference to the appended drawings. In the drawings.

DETAILED DESCRIPTION OF INVENTION

Preferred embodiments of the present invention will be described below by making reference to FIGS. 1 through 4(D) of the drawings.

Figure 1:
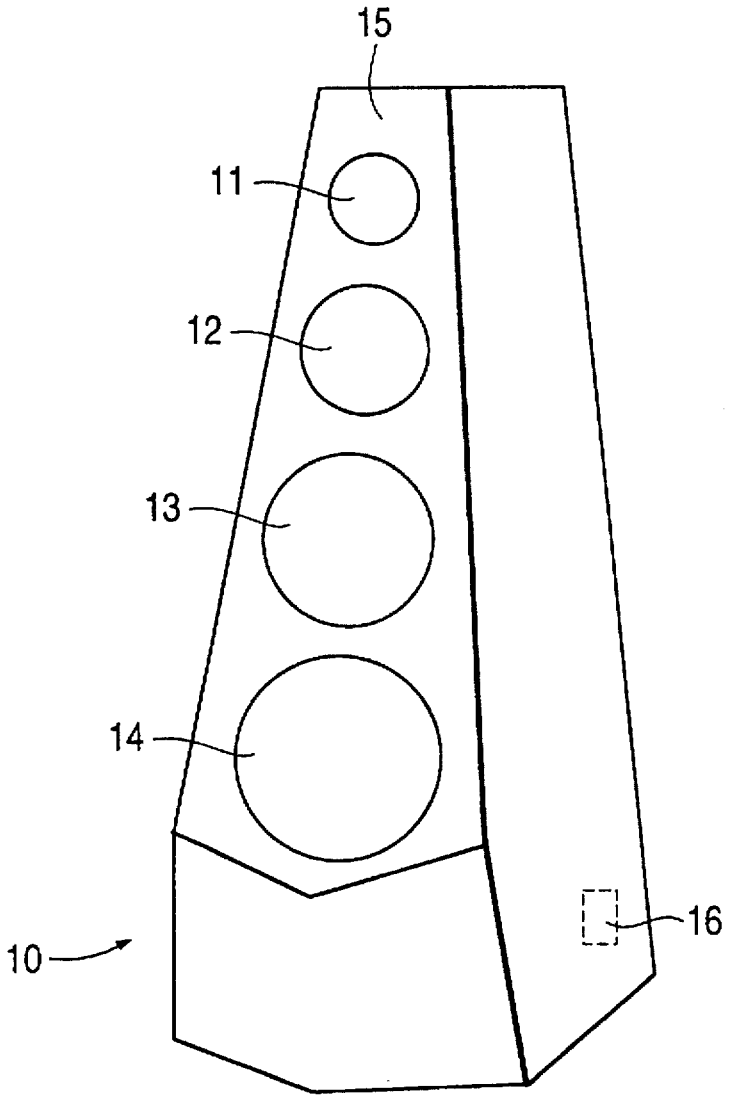
FIG. 1 is a perspective view of a loudspeaker equipped with a transducer mounting system according to the present invention.

The present invention was developed for use in a high performance loudspeaker, such as the loudspeaker 10 shown in FIG. 1. The loudspeaker 10 includes a plurality of speaker transducers 11, 12, 13, 14 (e.g., tweeter, midrange, port, woofer, etc.). The speaker components are mounted to a baffle board 15 of a speaker cabinet. Other electrical components, such as a terminal 16, are also mounted to the speaker cabinet.

Figure 2:
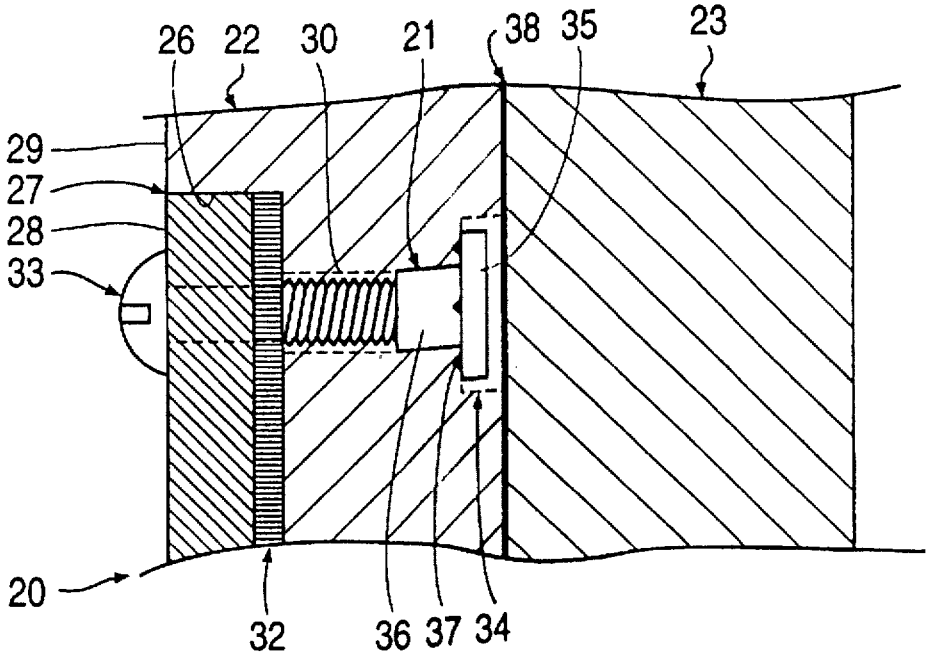
FIG. 2 is a cross sectional view of a transducer mounting system according to the present invention.
Figure 3:
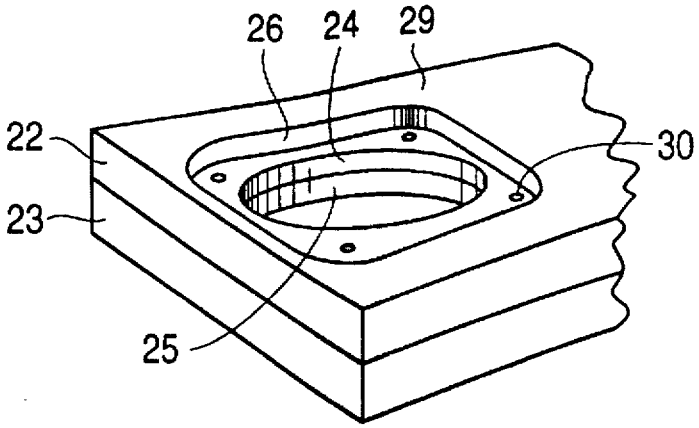
FIG. 3 is a perspective view of a portion of a loudspeaker baffle board having multiple layers for capturing T-nuts of the transducer mounting system according to the present invention.

Referring to FIGS. 2 and 3, a mounting system 20 according to the present invention for mounting the transducers 11, 12, 13, 14 to the baffle board 15 of the loudspeaker cabinet will be described. The mounting system 20 comprises a T-nut 21 captured between two layers 22, 23 of the loudspeaker baffle board 15. The layers 22, 23 of the baffle board 15 are each formed with central bores 24, 25 through which base portions of the transducers 11, 12, 13, 14 extend.

A recess 26 is formed about the circumference of the central bore 24 on the outer surface of the external layer 22. A mounting flange 27 of each of the transducers 11, 12, 13, 14 is received in the recess 26 so that an outer surface 28 of the mounting flange 27 is flush with the outer surface 29 of the baffle board layer 22. A plurality of mounting holes 30 extend through the external layer 22 for securing the transducers 11, 12, 13, 14 to the baffle board 15. The mounting holes 30 are aligned with corresponding mounting holes or slots (not shown) formed in the mounting flanges 27 of the transducers 11, 12, 13, 14.

A special gasket 32 (described below) is placed between the mounting flange 27 of the transducer 11, 12, 13, 14 and the bottom of the recess 26 of the baffle board 15. The gasket 32 is cut so as to have the same shape as the bottom surface of the recess 26, which also corresponds to the shape of the mounting flange 27 of the transducer 11, 12, 13, 14. A mounting screw 33 is inserted through each of the aligned mounting holes 30 and threaded into the T-nut 21.

A counterbore area 34, which is concentric with the mounting hole 30, is formed on an internal face of the external layer 22 of the baffle board 15 for receiving the head 35 of the T-nut 21. The shank 36 of the T-nut 21 is preferably friction fit into the mounting hole 30. A plurality of barbs 37 on the underside of the head 35 of the T-nut 21 engage a bottom surface of the counterbore 34 to prevent the T-nut 21 from rotating as the mounting screw 33 is torqued.

By fitting the T-nut 21 into the counterbore area 34 of the external layer 22, the full holding power of the T-nut 21 is maintained and high levels of torque can be applied to the mounting screw 33. The T-nut 21 will clamp more tightly against the outer layer 22 as the screw 33 is tightened and will not strip or rotate. The exposed counterbore area 34 is sealed by bonding the inner layer 23 of the baffle board 15 to the external layer 22 using a layer of adhesive 38, thereby producing an airtight mounting system.

Through the use of a suitable adhesive, such as wood glue, the bond between the two layers 22, 23 of the baffle board 15 is stronger than the material of the board itself. Thus, the mounting system 20 of the present invention does not compromise the mechanical strength of the baffle board 15.

The captured T-nut mounting system of the present invention is particularly suitable for high end loudspeakers because it requires a high level of precision and care from the loudspeaker cabinet builder. The machining tolerances of the counterbores and through-holes should be approximately ±0.2 mm to ensure proper alignment between all parts. Once the interior layer 23 is glued to the exterior layer 22, it is difficult to further adjust the alignment of parts. The preferred material for the loudspeaker cabinet is medium density fiberboard (MDF), but other suitable materials can also be used.

A typical assembly procedure involves the following steps: (1) initial cutting and machining of interior and exterior substrates (i.e., layers 22, 23 of the baffle board 15); (2) insertion of the T-nut 21; (3) gluing of the two substrates (layers 22, 23) using, for example, standard PVC-type wood glue (in the case of MDF); and (4) final machining of the baffle board 15. After step two, a small diameter paper or plastic sticker (not shown) is preferably placed over the rear side of the T-nut through-hole in order to prevent the gluing operation in step three from fouling the interior threads of the T-nut 21. The mounting screw 33 should be able to easily pierce this protection sticker.

The T-nuts 21 and machine screws 33 are preferably formed of very high strength materials, such as stainless steel, in order to take advantage of the much greater screw-down torque possible with the mounting system design according to the present invention.

Figure 4A:
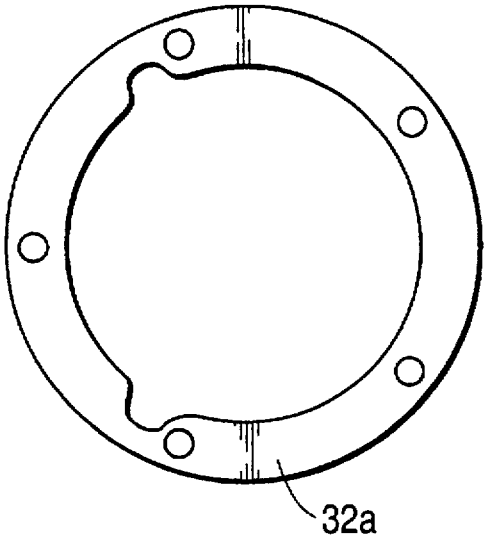
FIGS. 4(A), 4(B), and 4(C) are plan views of various gasket shapes for mounting loudspeaker transducers.
Figure 4B:
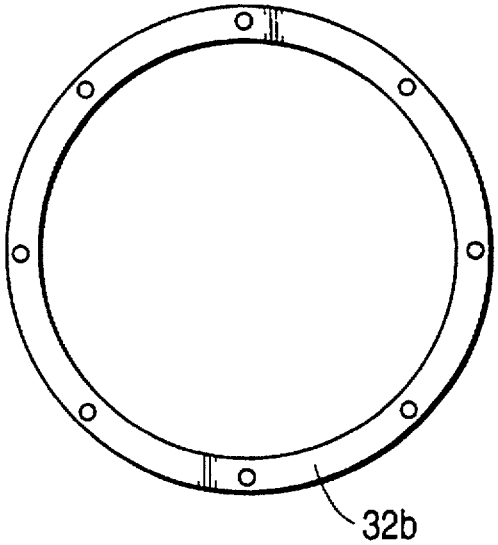
Figure 4C:
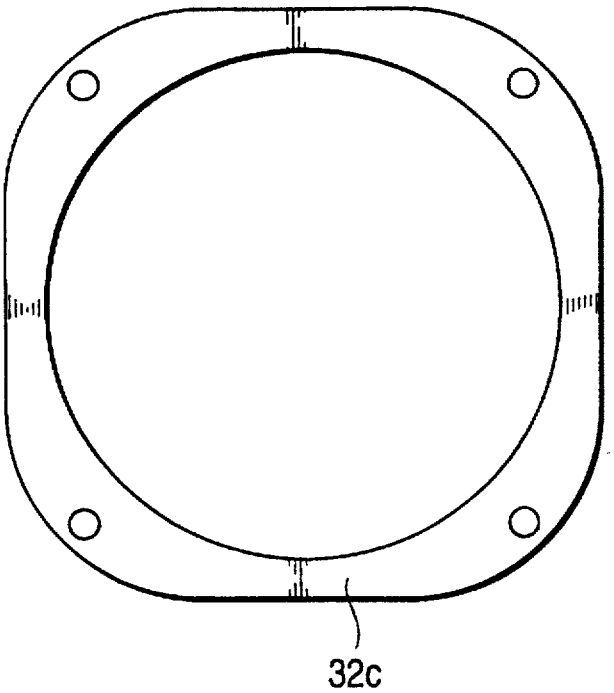
Figure 4D:
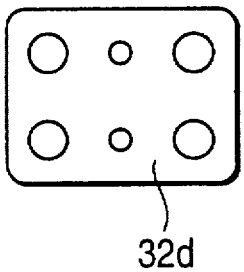
FIG. 4(D) is a plan view of a gasket shape for mounting a loudspeaker terminal.

FIGS. 4(A), 4(B), and 4(C) show various shapes of gaskets **32*a*, 32*b*, and 32*c*, respectively, that may be used in the present invention. The shape of the gaskets 32*a*, 32*b*, 32*c* conform to the mounting flange 27 of the particular transducer 11, 12, 13, 14 to be mounted and to the shape of the recesses 26 formed in the baffle board 15. The terminal 16 of the loudspeaker 10 may also be fitted with a gasket 32*d***, as shown in FIG. 4(D).

The optimized gasket 32 used in the mounting system 20 of the present invention preferably features the following: (1) a very high degree of compressibility (e.g., 20 $ft^3$/lb nominal density); (2) an extremely low compression set and resistance to collapse (e.g., less than 0.2%); (3) a high level of environmental resistance (e.g., water absorption, thermal stability, cold flexibility, UV resistance, outgassing); (4) a high level of tear resistance; and (5) a high level of dimensional stability (i.e., precise thickness and predictable load-deflection behavior).

The ideal material for the gasket 32 is a thin sheet of casted, fine-celled polyurethane foam which exhibits open-cell foam characteristics at moderate deflections but provides completely airtight sealing at deflections greater than 50%. In the present invention, a deflection of the gasket material of 90 to 95% can be applied to cause the gasket material to act as a closed-cell foam or solid elastomer. The gasket 32 preferably has a nominal thickness of approximately 1.5 mm with "skinned" top and bottom surfaces.

The high degree of compressibility of the gasket 32 allows for intimate contact between the transducer flange 27 and the enclosure 15 while completely filling the smallest surface-to-surface interface gaps. A very rigid mechanical coupling between the transducer 11, 12, 13, 14 and cabinet 15 is obtained while maintaining a completely airtight seal between the two. The extremely low compression set of the gasket 32 provides a constant return force against the mounting screw 33 to prevent any loosening with vibration over time. The high level of environmental resistance prevents air leaks from occurring over wide variations in temperature and humidity. The high degree of tear resistance prevents damage during installation of the gasket 32, even if the alignment between the gasket 32, transducer flange 27 and cabinet 15 is not exact.

A suitable gasket material for the present invention is produced by E-A-R Specialty Composites, a division of Cabot Safety Corporation, under the proprietary name, ISO-LOSS® LS High-Density Cellular Urethanes (Part Number LS-2006). This material is a high density, cellular polyurethane which is approximately 1.5 mm thick. The following Table 1 provides a listing of acceptable physical and strength properties for the gasket material according to the preferred embodiment.

TABLE 1

PROPERTIES OF THE GASKET MATERIAL

| PROPERTY | TEST METHOD | TEST RESULTS |
|---|---|---|
| Density Nominal | ASTM D3574 | 25 lb/ft$^3$ |
| Flammability | UL 94 Horizontal | Listed HBF |
| | MVSS-302 | Meets |
| Dielectric Strength | ASTM D149 | 56 V/mil |
| Thermal Stability | TGA Decomposition Temperature @ 1.1° C./min Heat Rise | 233° C. |
| Vertical Rebound | ASTM D2632 (Bashore Resilience @ 22° C.) | 34% |
| Thermal Conductivity | ASTM C177 BTU-in/hr-ft$^2$-°F. | 0.371 |
| Volume Resistivity | ASTM D257, ohms-cm | $1.3 \times 10^{11}$ |
| Hardness | ASTM D2240 Durometer 15 Sec. Post Impact Shore 0 | 28 |
| Compression Set | 50% Compression | |
| | ASTM D1667 (22 hrs @ 23° C.) | 0.19% |
| | ASTM D3574 (22 hrs @ 70° C.) | 1.3% |
| | ASTM D3574 (after 5 hrs autoclave @ 121° C.) | 2.2% |
| Compression Load Deflection | ASTM D3574, psi Deflection: | |
| | 10% | 16 |
| | 20% | 22 |
| | 30% | 28 |
| | 40% | 38 |
| | 50% | 54 |

TABLE 1-continued

PROPERTIES OF THE GASKET MATERIAL

| PROPERTY | TEST METHOD | TEST RESULTS |
|---|---|---|
| Taber Abrasion | Precision Test Method, H-38 Stone with a 1000 gm load, % wt. loss: | |
| | 1000 cycles | 0.6% |
| | 2000 cycles | 1.1% |
| | 3000 cycles | 1.7% |
| | 4000 cycles | 2.2% |
| | 5000 cycles | 2.8% |
| Dimensional Stability | ASTM D1204 | −1% |
| | GM 6098M | Meets |
| Tensile Strength (psi) | ASTM D3574-Rate 20 in/min | 172 |
| | Autoclaved (120° C. for 5 hrs) | 191 |
| Tear Resistance | ASTM D624, lbf/in | 17.5 |
| Elongation | ASTM D3574 Rate 20 in/min | 150% |
| | Autoclaved (121° C. for 5 hrs) | 201% |

The gasket material can be easily die-cut to the exact shape of the gasket 32. To minimize waste of the gasket material, several different size gaskets (e.g., for different size transducers) are preferably die-cut concentrically from a single sheet of gasket material. The gasket material may be provided with a pressure-sensitive adhesive (PSA) backing. However, such a backing tends to hinder the assembly operation due to the large size and precision placement necessary to assemble the transducers 11, 12, 13, 14 to the baffle board 15. Therefore, in the preferred embodiment, the gasket material is not provided with an adhesive backing. The preferred gasket material is reusable many times due to its high level of tear resistance and lack of compression set.

The present invention is concerned primarily with the optimization of a transducer to loudspeaker enclosure interface. The gasket design and captured T-nut mounting arrangement according to the present invention can be used in any type of loudspeaker design independent of the actual cabinet material or transducer size or shape. A molded cabinet, for example, can utilize an insert molding technique to capture the T-nut and still use the same gasket design.

The mounting system of the present invention is applicable whenever it is desired to have airtight sealing, rigid mechanical coupling, freedom from environmental variations, immunity to vibration-induced loosening over time, and so forth.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

The invention claimed is:

1. A mounting system for mounting a transducer to an enclosure, comprising:

a baffle board comprising a first substrate bonded to a second substrate, and at least one bore extending through each of said substrates for receiving a transducer;

at least one mounting hole extending through said first substrate, a counterbore being formed in the first substrate coaxial with said mounting hole on a side of the first substrate facing the second substrate;

a T-nut having a head located in said counterbore, said second substrate covering said counterbore so as to form an airtight seal thereover; and a threaded fastening member extending through a mounting flange of the transducer and into the mounting hole of the first substrate, said fastening member being threaded into said T-nut for securing the transducer to the baffle board.

2. The mounting system according to claim 1, wherein a plurality of mounting holes are formed in the first substrate about a circumference of the bore through said first substrate, each of said mounting holes having a counterbore formed on a side facing the second substrate.

3. The mounting system according to claim 1, further comprising a recess formed about a circumference of the bore through said first substrate for receiving the mounting flange of the transducer, said mounting hole being located in a bottom surface of said recess.

4. The mounting system according to claim 1, wherein the T-nut has barbs formed on the head thereof for engaging a bottom surface of the counterbore to prevent the T-nut from rotating as the fastening member is tightened.

5. The mounting system according to claim 1, further comprising a gasket disposed between the mounting flange of the transducer and the first substrate.

6. The mounting system according to claim 5, wherein said gasket is made of a material having a high degree of compressibility, a low compression set and resistance to collapse, a high environmental resistance, a high tear resistance, and a high dimensional stability.

7. The mounting system according to claim 5, wherein said gasket is made of a polyurethane material.

8. The mounting system according to claim 5, wherein said gasket is made of a casted, fine-celled polyurethane foam material which exhibits open-cell foam characteristics at moderate deflections and provides completely airtight sealing at deflections greater than 50%.

9. A method for mounting a transducer to a loudspeaker cabinet, comprising the steps of:

providing an interior substrate and an exterior substrate;

forming a bore through each of the substrates for receiving a transducer;

forming at least one mounting hole through the exterior substrate;

forming a counterbore on one side of the exterior substrate, the counterbore being coaxial with said mounting hole;

inserting a T-nut into the counterbore; and bonding the interior substrate to the exterior substrate so that the interior substrate covers the counterbore and forms an airtight seal over the counterbore.

10. The method according to claim 9, further comprising the steps of:

positioning a transducer in alignment with the bore through the exterior substrate;

inserting a fastening member through a mounting flange of the transducer and into the mounting hole of the exterior substrate;

threading the fastening member into the T-nut and tightening the fastening member to a predetermined torque.

11. The method according to claim 10, further comprising the step of placing a gasket between the exterior substrate and the mounting flange of the transducer.

12. The method according to claim 11, further comprising the steps of:

forming the gasket out of a thin sheet of casted, fine-celled polyurethane foam which exhibits open-cell foam characteristics at moderate deflections but is completely airtight at deflections greater than 50%; and compressing the gasket between the mounting flange and the baffle board to a deflection greater than 50% to form an airtight seal between the transducer and the baffle board.

13. The method according to claim 10, further comprising the step of placing a paper or plastic sticker over the counterbore to prevent adhesive from entering the counterbore during the bonding step.

14. A loudspeaker having an optimal transducer mounting system, comprising:

an enclosure having a baffle board;

at least one transducer mounted to said baffle board by a mounting system, the mounting system comprising a plurality of fastening members extending through a mounting flange of the transducer and into the baffle board;

wherein a gasket is placed between said mounting flange and said baffle board, said gasket comprising a thin sheet of casted, fine-celled polyurethane foam which exhibits open-cell foam characteristics at moderate deflections but is completely airtight at deflections greater than 50%, further comprising a plurality of T-nuts embedded in receiving spaces of said baffle board, said fastening members being threaded into said T-nuts to secure the transducer to the baffle board, said receiving spaces being sealed off from an interior of said enclosure, wherein said baffle board comprises an interior substrate bonded to an exterior substrate, said exterior substrate having a plurality of mounting holes extending therethrough for receiving said fastening members, said receiving spaces comprising counterbores formed in said exterior substrate on a side facing said interior substrate, said interior substrate forming a seal over said counterbores for sealing off the counterbores from the interior of the enclosure.

15. The loudspeaker according to claim 14, wherein said gasket has a nominal thickness of approximately 1.5 mm with skinned top and bottom surfaces.

16. The loudspeaker according to claim 14, wherein said gasket is compressed between said mounting flange and said baffle board at a deflection greater than 50% to form an airtight seal between said transducer and said baffle board.

* * * * *